US011035124B2

(12) United States Patent
Baldassi

(10) Patent No.: US 11,035,124 B2
(45) Date of Patent: Jun. 15, 2021

(54) GUTTER INSERT

(71) Applicant: James Baldassi, Guelph (CA)

(72) Inventor: James Baldassi, Guelph (CA)

( * ) Notice: Subject to any disclaimer, the term of this patent is extended or adjusted under 35 U.S.C. 154(b) by 0 days.

(21) Appl. No.: 16/846,525

(22) Filed: Apr. 13, 2020

(65) Prior Publication Data

US 2020/0340251 A1 Oct. 29, 2020

Related U.S. Application Data

(60) Provisional application No. 62/837,790, filed on Apr. 24, 2019.

(51) Int. Cl.
*E04D 13/064* (2006.01)

(52) U.S. Cl.
CPC ..... *E04D 13/0643* (2013.01)

(58) Field of Classification Search
CPC ... E04D 13/64; E04D 13/0643; E04D 13/068; E04D 13/076
USPC ..... 52/11, 12
See application file for complete search history.

(56) References Cited

U.S. PATENT DOCUMENTS 3,611,731 A * 10/1971 Edmondson ..... E04D 13/064 405/120
4,338,808 A * 7/1982 Weiss ..... B21D 5/16 248/48.2
6,085,466 A * 7/2000 Martin ..... E04D 13/076 52/11
7,076,921 B2 * 7/2006 Spradlin ..... E04D 13/0641 248/48.1
7,765,743 B2 * 8/2010 Guilford ..... E04D 13/076 52/12
D654,574 S * 2/2012 Davis ..... D23/267
8,763,310 B2 * 7/2014 Dehart, Sr. ..... E04D 13/064 52/11
9,062,460 B2 * 6/2015 Dehart, Sr. ..... E04D 13/068
9,879,429 B2 * 1/2018 Joly, Jr. ..... B21D 51/16
10,077,557 B2 * 9/2018 Joly ..... B21D 51/16
D831,176 S * 10/2018 Bulla ..... D23/267
10,640,982 B1 * 5/2020 Bulla ..... E04D 13/068
(Continued)

*Primary Examiner* — Brian E Glessner
*Assistant Examiner* — James J Buckle, Jr.

(57) ABSTRACT

The present concept is a gutter insert designed to fit within the corner section of an eaves trough. The gutter insert includes a substantially horizontal bottom wall which includes an arcuate back periphery, and an inner peripheral edge and an upstanding back wall rigidly connected to the horizontal bottom surface at the arcuate back periphery of the horizontal bottom wall, wherein the upstanding back wall together with the horizontal bottom wall define a first and a second transverse edge, which include a first and second upstanding edge respectively. The horizontal bottom wall is configured to lie adjacent to a base of the corner section of an eaves trough and extends between the inner sidewall and an outer sidewall of corner section of an eaves trough at the first and second transverse edges. The inner peripheral edge is configured to lie substantially adjacent an inner sidewall of the corner section of an eaves trough such that the horizontal bottom wall, the upstanding back wall of the gutter insert, together with an inner side wall of the corner section of an eaves trough form a channel directing the flow of water smoothly around the corner of a corner section of an eaves trough.

8 Claims, 6 Drawing Sheets

(56) References Cited

U.S. PATENT DOCUMENTS

| | | | | |
|---|---|---|---|---|
| 2004/0257801 | A1* | 12/2004 | Cheema | F21S 4/20 362/152 |
| 2006/0225368 | A1* | 10/2006 | Roe | E04D 13/064 52/12 |
| 2009/0107053 | A1* | 4/2009 | Guilford | E04D 13/0643 52/12 |
| 2012/0066983 | A1* | 3/2012 | Dehart, Sr. | E04D 13/0643 52/11 |
| 2014/0047779 | A1* | 2/2014 | Dehart, Sr. | E04D 13/068 52/11 |
| 2015/0300024 | A1* | 10/2015 | Joly, Jr. | E04D 13/0643 52/13 |
| 2019/0330852 | A1* | 10/2019 | Gori | E04D 13/068 |

* cited by examiner

GUTTER INSERT

FIELD OF THE INVENTION

The present device relates to an insert for corner sections of a conventional eavestroughing and more particularly relates to a gutter insert for an inside corner and a gutter insert for an outside corner of conventional gutters or eavestroughing.

SUMMARY OF THE INVENTION

A gutter or eaves trough for the purpose of this application is a shallow trough fixed at the edge of a roof for carrying off rainwater. Gutter and eaves trough are used interchangeably herein and refer to the same thing. Conventional commonly used gutters or eaves trough are manufactured from roll formed sheet aluminum and are attached to the fascia board of the roof edge of a house using various attachment mechanisms that are commonly available. Inside corners and the outside corners of a conventional eaves trough system is normally simply a mitered corner which either the installer miters on site from the straight sections of formed gutter or eaves trough or may be pre-mitered inside and outside corners pieces which can be purchased are glued and screwed to the straight portions of the gutter at the inside corner junctions and the outside corner junctions of the gutter or eaves trough. The glue is often water poof caulking such as silicone sealant for example. There are millions of conventional gutter or eaves trough installations in place in North America The conventional gutter systems result in sharp edged interior and exterior corner joints of the gutter or eaves trough sections. These sharp corners tend to create a substantial amount of turbulent flow around the sharp inner corner portion and/or outer corner portions of the corner sections.

Unfortunately, these sharp edge interior and exterior corner joints due to the creation of turbulence at these joints tends to result in the buildup of leaves and debris at the interior and exterior corners of the corner sections of the eaves trough due to whirlpools, eddies and other non-uniform flow around the sharp edge interior and exterior corner joints.

The prior art has identified this deficiency in the conventional gutter or eaves trough systems. One solution proposed in U.S. Pat. No. 6,085,466 under the title Rain Gutter Corner Segment Construction filed by Walter Martin and Jeanne Martin which was issued on Jul. 11, 2000. This patent describes rain gutter corner segments having a curved or arcuate form rather than a sharp-edged interior and exterior corner joint. The system described is not designed to be retrofitted to a conventional gutter system and completely changes the exterior look.

In addition, U.S. Pat. No. 8,567,130 titled 'One Piece Corner Fitting' by John Winston Rhodes which was issued on Oct. 29, 2013 describes an insert for placement into an existing corner section of an eavestrough in order to repair a corroded or failed sharp edged corner joint. This patent explains that sharp edged corner joints tend to fail in part due to the accumulation of leaves and debris at the corner joint creating damming and potential ice damage as a result. The present concept provides retro fit-able solution which could prevent this problem.

Unfortunately, none of the prior art describes a gutter inset which can be used easily and without difficulty installed into existing gutter or eaves trough configurations which have sharp edged interior and exterior corner joints without the need for completely renewing the eaves trough installation and without changing the exterior visual appearance of the existing gutter system. There is a need for improving the flow characteristics of the sharp-edged interior and exterior corner joints of conventional gutter systems without expensive complete re-installations or modifications to the sharp edged corners and without changing the existing exterior look of the gutters and gutter corners.

It is an object of the present concept to provide a simple and efficient rain gutter corner insert that minimizes turbulent flow around sharp edged corners and the buildup of leaves and debris at the interior and exterior corners of a rain gutter and which will promote both self-flushing of the gutter trough as well as simplify cleaning of gutter corners.

SUMMARY OF THE INVENTION

The present concept a gutter insert designed to fit within the corner section of an eaves trough, the gutter insert includes a) a substantially horizontal bottom wall which includes an arcuate back periphery, and an inner peripheral edge;

b) an upstanding back wall rigidly connected to the horizontal bottom surface at the arcuate back periphery of the horizontal bottom wall, wherein the upstanding back wall together with the horizontal bottom wall includes a first and a second transverse edge, which includes a first and second upstanding edge respectively;

c) the horizontal bottom wall is configured to lie adjacent to a base of the corner section of an eaves trough and extends between the inner sidewall and an outer sidewall of the corner section of an eaves trough at the first and second transverse edges;

d) wherein the inner peripheral edge is configured to lie substantially adjacent an inner sidewall of the corner section of an eaves trough;

e) such that the horizontal bottom wall, the upstanding back wall of the gutter insert, together with an inner side wall of the corner section of an eaves trough form a channel directing the flow of water smoothly around the corner of a corner section of an eaves trough.

Preferably wherein the inner peripheral edge is a V shape to follow the contour of the inner corner portion of the corner section of an eaves trough, wherein the inner apex of the corner section of an eaves trough is adjacent to an apex of the V shaped peripheral edge thereby preventing longitudinal movement of the gutter insert in an installed position within the corner section of an eaves trough.

Preferably wherein a first arm and a second arm of the V shaped peripheral edge extend substantially perpendicular to each other.

Preferably wherein the upstanding back wall is substantially perpendicular to the horizontal bottom wall and contacts the outer side wall of the corner section of an eaves trough, at the first and second upstanding edge.

Preferably wherein the upstanding back wall substantially follows the cross sectional contour of and lies adjacent to the outer side wall at the first and second upstanding edge.

Preferably wherein a corner section of an eaves trough is an inside corner and the upstanding back wall deflects water around a corner in a smooth arcuate path.

Preferably wherein a corner section of an eaves trough is an outside corner and the upstanding back wall deflects water around a corner in a smooth arcuate path.

Preferably wherein the vertical height of the upstanding back wall is lower than the vertical height of the outer side wall of a corner section of an eaves trough.

Preferably wherein the vertical height of the upstanding back wall is lower than vertical height of the outer side wall top lip of a corner section of an eaves trough such that the back wall is wedged between the base and top lip of a corner section of an eaves trough.

BRIEF DESCRIPTION OF THE DRAWINGS

With the intention of providing demonstration of the characteristics of the device or method, an example or examples are given below, without any restrictive character whatsoever, with reference to the corresponding figures of preferred embodiments of the device and method as follows.

DESCRIPTION OF THE PREFERRED EMBODIMENTS

Figure 1:
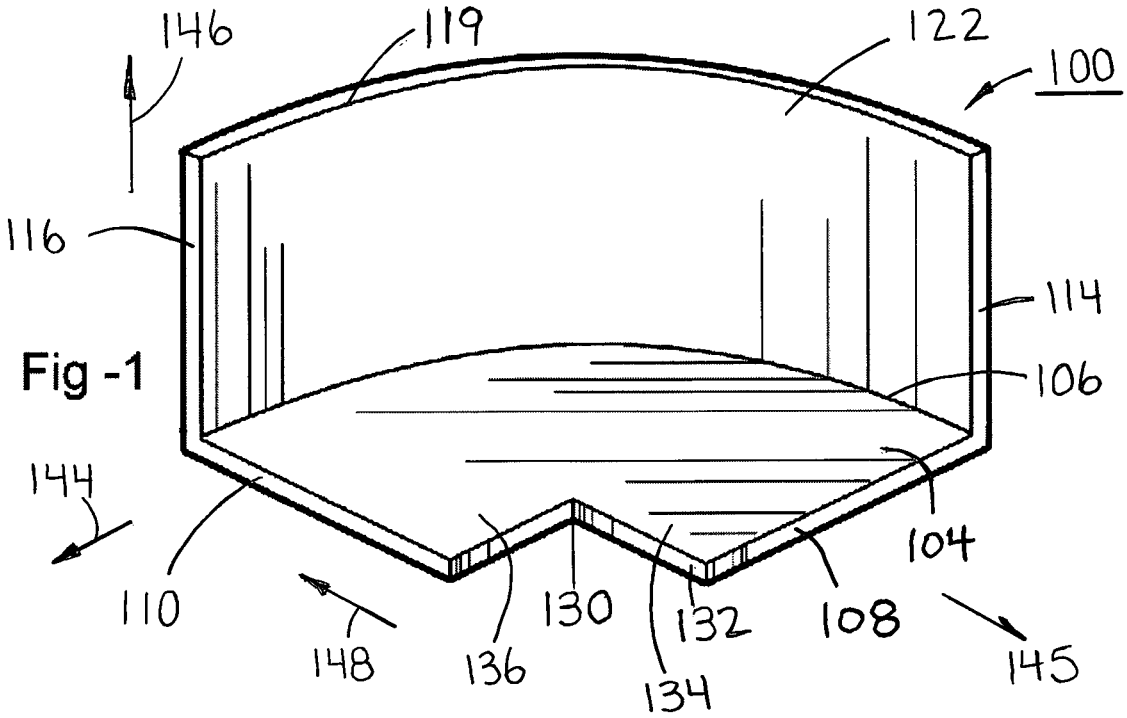
FIG. 1 is a schematic front top perspective view of a gutter insert for an inside corner.
Figure 2:
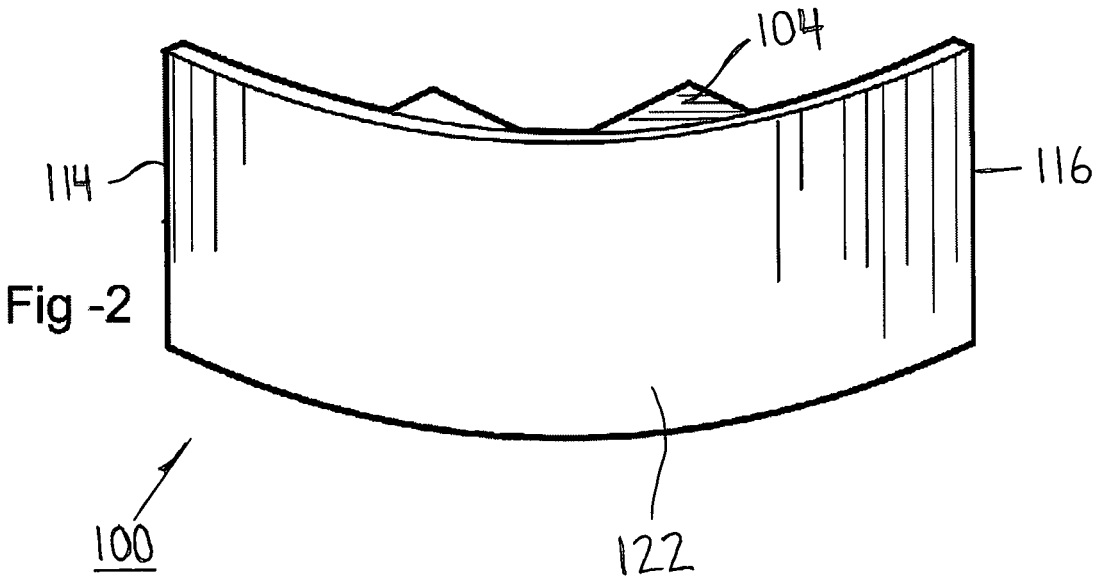
FIG. 2 is a schematic back top perspective view of the gutter insert shown in FIG. 1.
Figure 3:
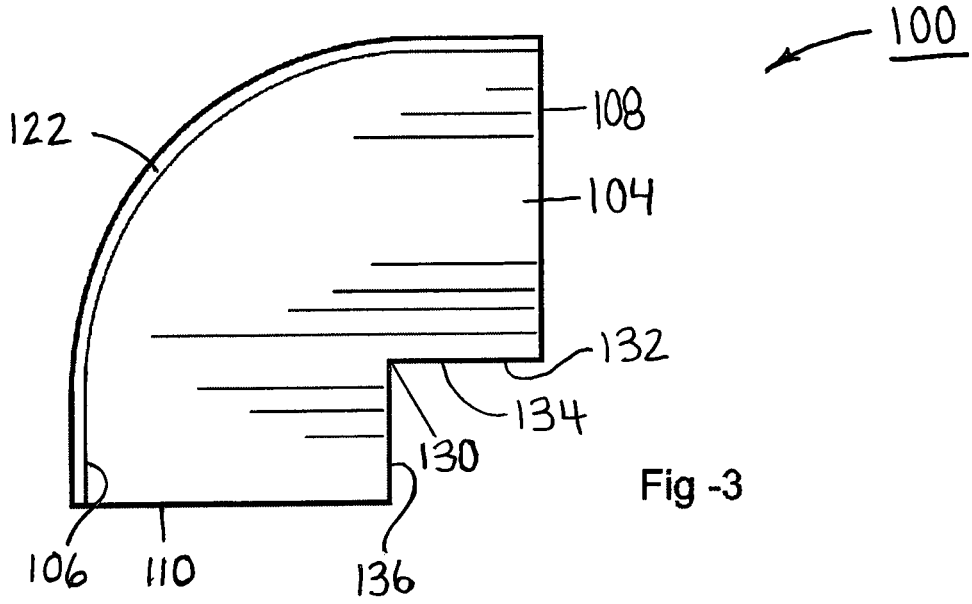
FIG. 3 is a schematic top plan view of the gutter insert shown in FIG. 1.
Figure 4:
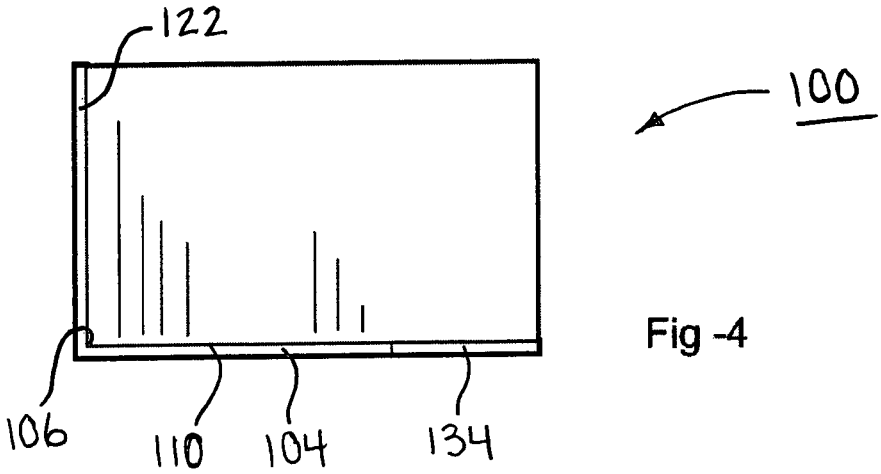
FIG. 4 is a schematic left side plan view of the gutter insert shown in FIG. 1.
Figure 5:
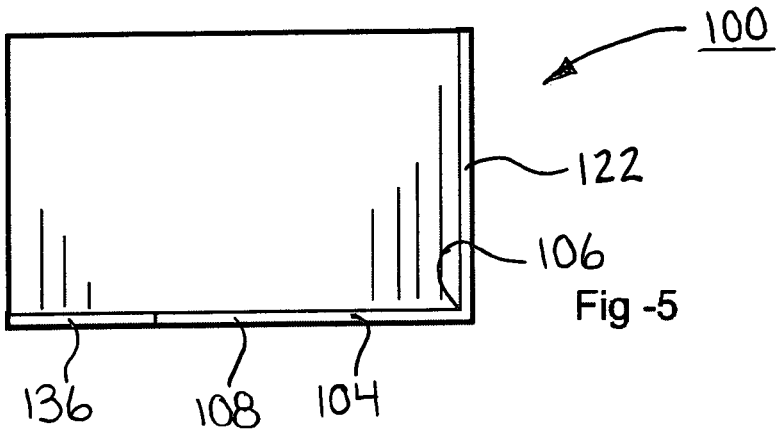
FIG. 5 is a schematic right side plan view of the gutter insert shown in FIG. 1.

The present concept is shown in FIGS. 1-6 for a gutter insert 100 for an inside corner and FIGS. 7-12 which is a gutter insert 200 for an outside corner. The inside corner 100 and outside corner 200 have many similarities in that both include a bottom wall 104, 204 and a back wall 122, 222.

Referring first of all to FIGS. 1-6 a gutter insert for an inside corner of a gutter or eaves trough is shown generally as 100.

Gutter insert 100 includes the following major components, namely bottom wall 104 which is rigidly connected to an upstanding curved or arcuate back wall 122 at back periphery 106.

Bottom wall 104 includes an inner peripheral edge 132 which includes a first arm 134 and a second arm 136 which meet at apex 130. Gutter insert for an inside corner 100 further includes a first transverse edge 108 and a second transverse edge 110. First transverse edge 108 includes a first upstanding edge 114 and second transverse edge 110 includes a second upstanding edge 116.

Gutter insert 100 further includes a top edge 119 which is the top curve or arcuate portion of the back wall 122 and gap 180 which is the space between top edge 119 and outer side walls 120 proximate outer apex 138.

Gutter insert 100 is described with reference to a first longitudinal direction 144 and a second longitudinal direction 145 which generally corresponds to the direction of the longitudinal lengths of gutters or eaves trough that connect to the corner portions. Gutter insert 100 is further described with reference to vertical direction 146 and radial direction 148.

Figure 6:
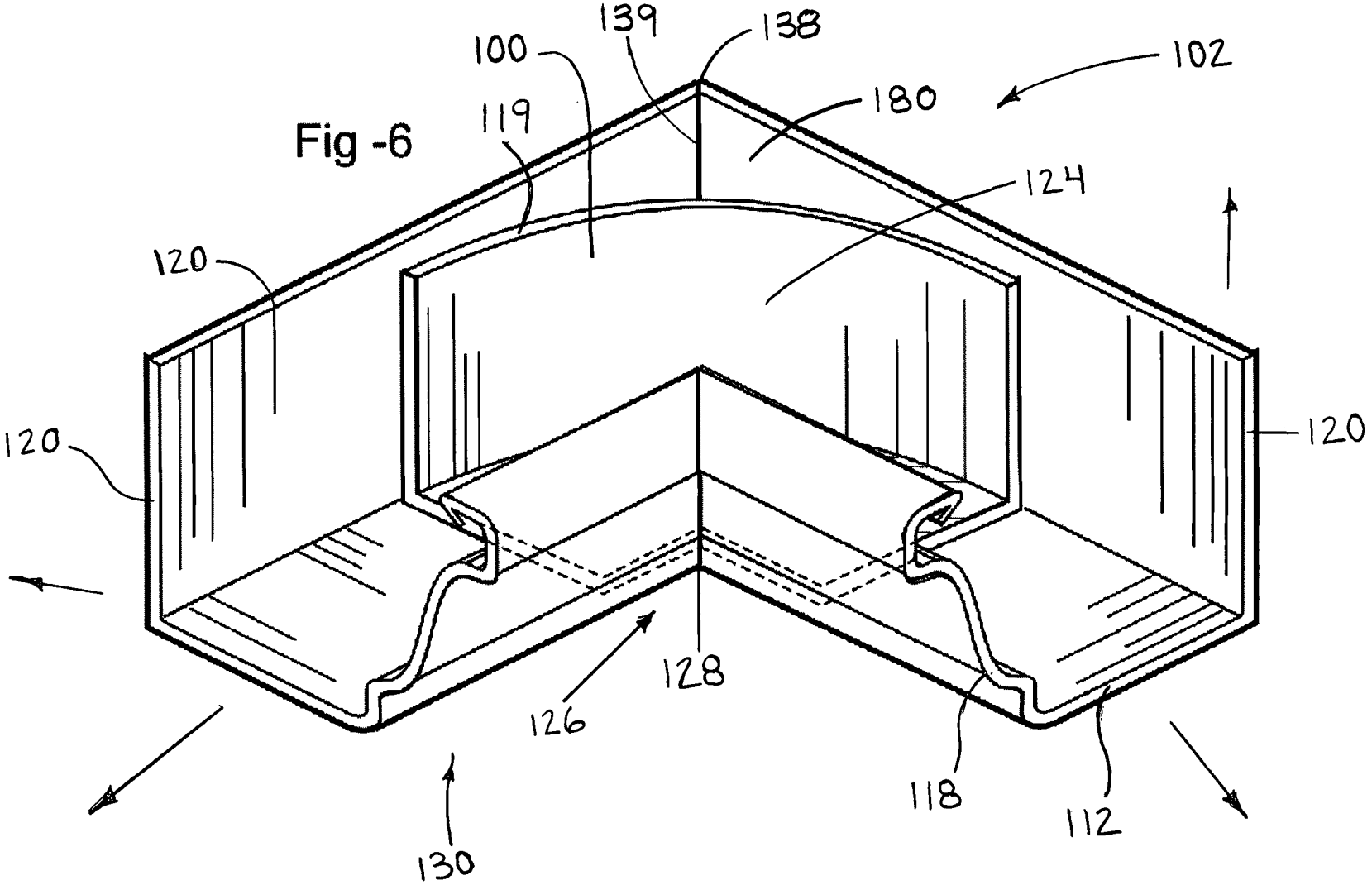
FIG. 6 is a top schematic perspective view of an inside gutter insert shown in FIG. 1 deployed in a conventional sharp edged mitered inside corner section of an eaves trough.
Figure 7:
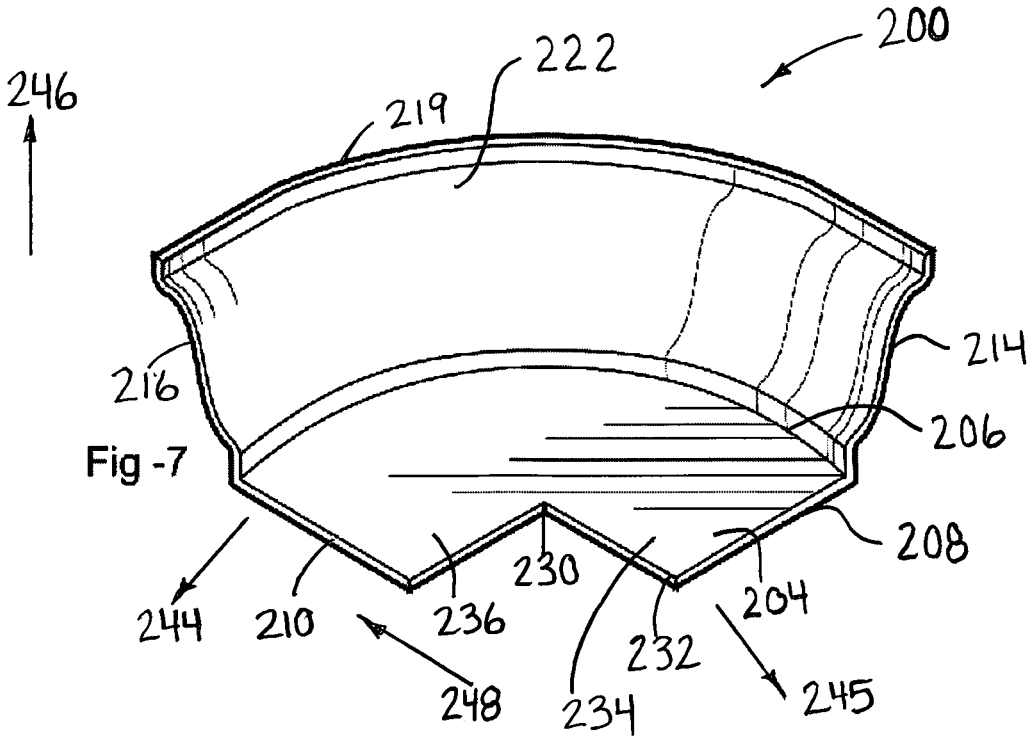
FIG. 7 is a schematic front top perspective view of a gutter insert for an outside corner.
Figure 8:
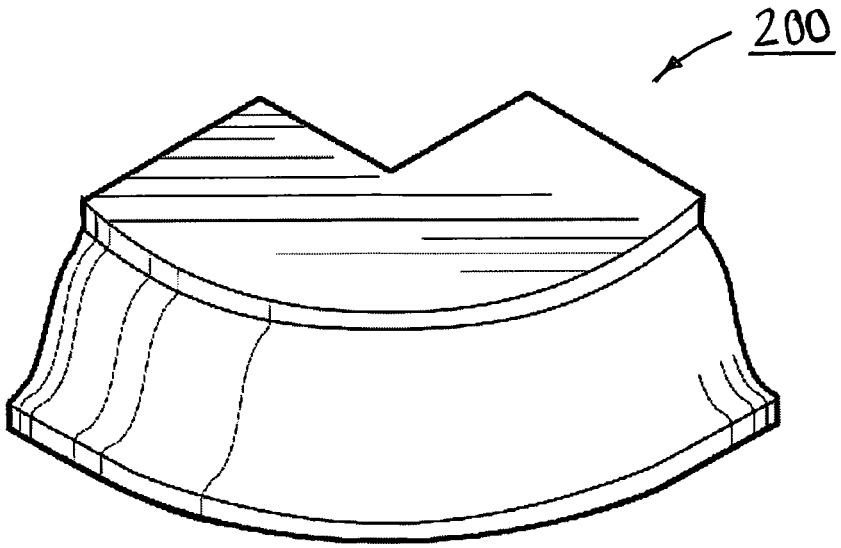
FIG. 8 is a schematic back bottom perspective view of the gutter insert shown in FIG. 7.
Figure 9:
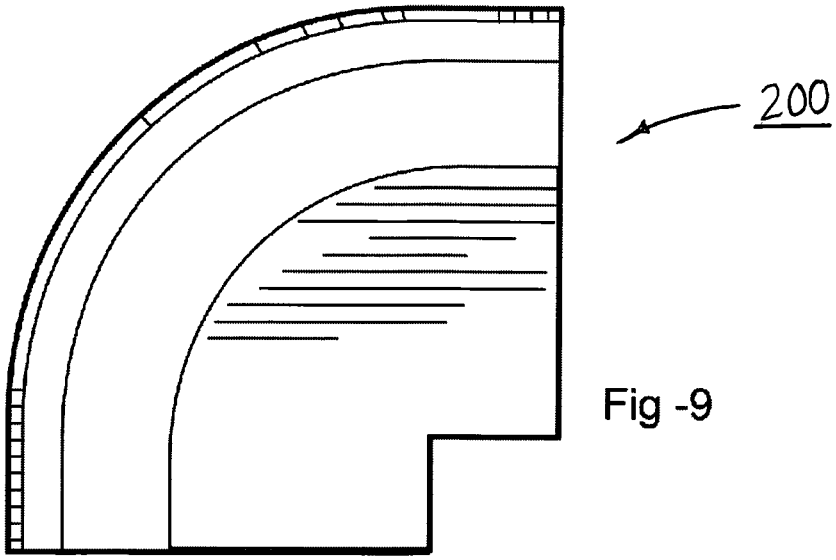
FIG. 9 is a schematic top plan view of the gutter insert shown in FIG. 7.
Figure 10:
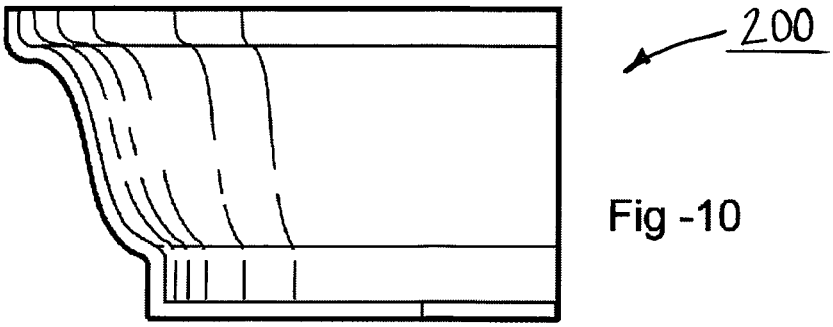
FIG. 10 is a schematic left side plan view of the gutter insert shown in FIG. 7.
Figure 11:
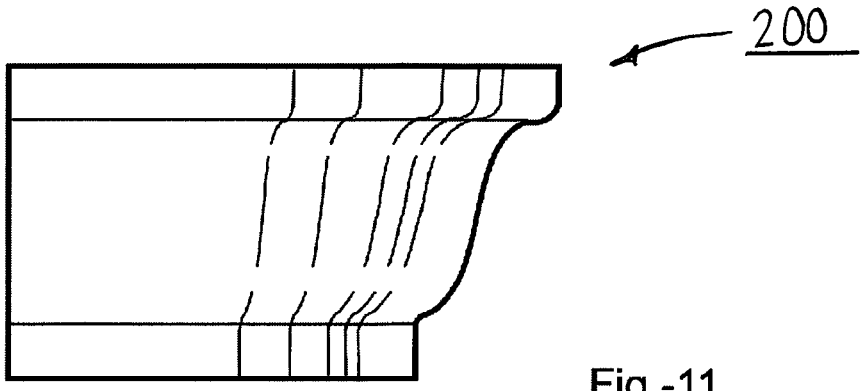
FIG. 11 is a schematic right side plan view of the gutter insert shown in FIG. 7.

Referring now to FIG. 6 which is a top schematic view of gutter insert 100 for an inside corner deployed in an installed position 130 in a conventional sharp cornered mitered inside corner section of an eaves trough shown as 102 where in gutter insert 100 is shown in an installed position 130 with gutter insert 100 housed within an inside corner section of an eaves trough 102 also referred to as an eaves trough corner section.

The inside corner section of an eaves trough 102 includes an inner sidewall 118, a base 112, an outer sidewall 120, an inner corner section 126 with an inner apex 128. Outer sidewalls 120 meet at outer miter 139 at outer apex 138.

Referring now to FIGS. 7-12 which depict a gutter insert for an outside corner shown generally as 200 includes the following major components, namely a bottom wall 204 a back wall 222 which is connected to the bottom wall 204 at back periphery 206.

Bottom wall 204 includes a first transverse edge 208 which includes a first upstanding edge 214 and further includes a second transverse edge 210 which includes a second upstanding edge 216.

Bottom wall 204 also includes am inner peripheral edge 232 which a first arm 234 and a second arm 236 which meet at apex 230.

Gutter insert 200 further includes a top edge 219. Gutter insert 200 is described with reference to the following directions, namely first longitudinal direction 244, second longitudinal direction 245, first vertical direction 246, and radial direction 248.

Figure 12:
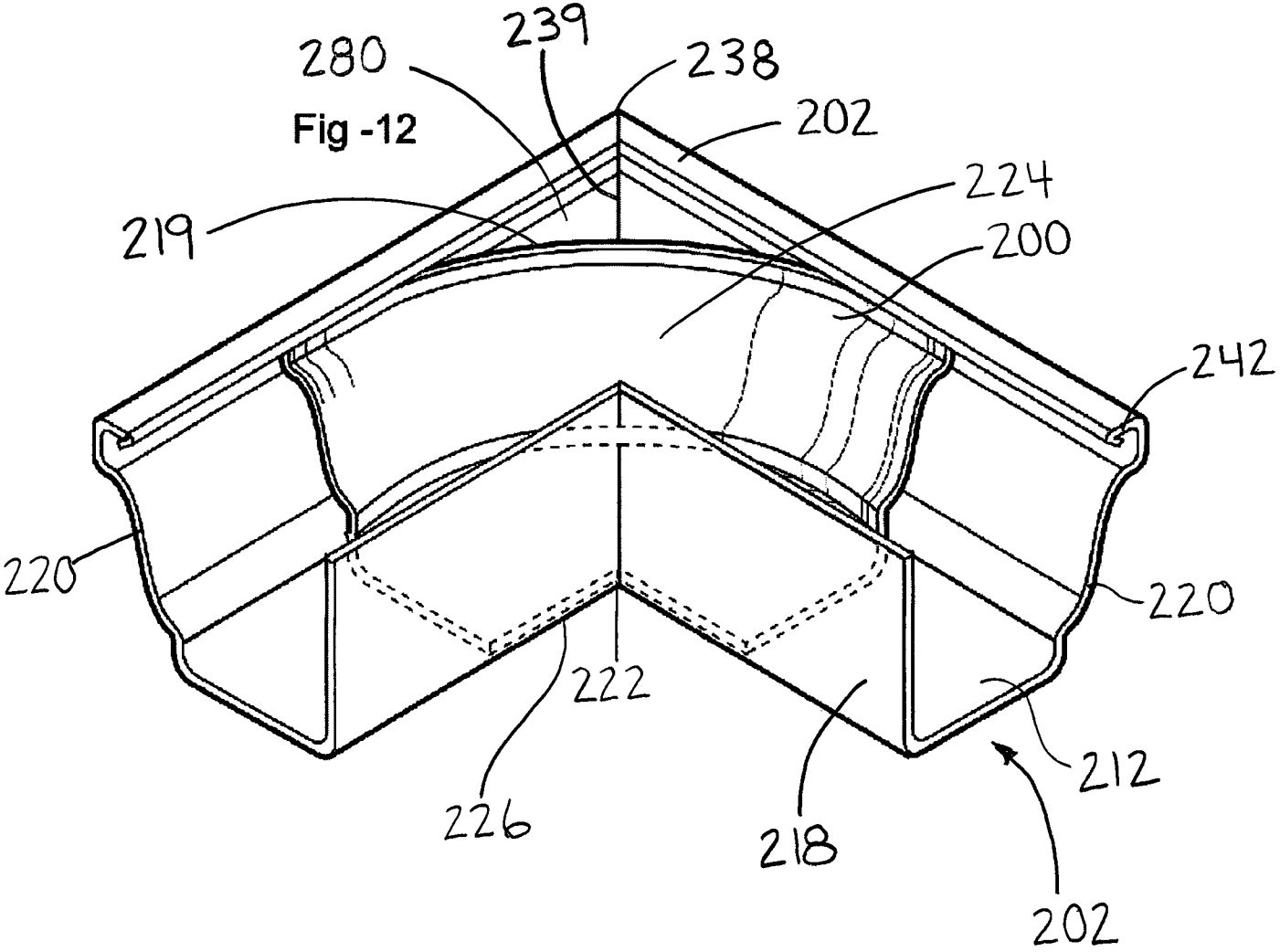
FIG. 12 is a schematic back top view of an outside gutter insert shown in FIG. 7 deployed in a conventional sharp edged mitered outside corner section of an eaves trough.

Referring now to FIG. 12 gutter insert 200 is shown deployed in a conventional sharp cornered mitered outside corner section of an eaves trough 202 also referred to as eaves trough outside corner section. Outside corner section of an eaves trough 202 includes a base 212, an inner sidewall 218, an outer sidewall 220, inner corner portion 226, inner apex 222, outer miter 239, outer apex 238, top edge 219 and gap 280 which is the space between top edge 219 and outer side walls 220 proximate outer apex 238.

Referring to FIGS. 6 and 12 gutter insert 100 and 200 is designed to fit within a corner section of an eavestrough 102, 202 where in the gutter insert 100, 200 includes a substantially horizontal bottom wall 104, 204 which includes an arcuate back periphery 106, 206 and an inner peripheral edge 132, 232.

Upstanding back wall 122, 222 is rigidly connected to the horizontal bottom surface 104, 204 at the arcuate back periphery 106, 206 of the horizontal bottom wall 104, 204 wherein gutter inserts 100, 200 include upstanding back wall 122, 222 rigidly connected to horizontal bottom wall 104, 204 and are bounded by a first and second transverse edge 108, 208, and 110, 210, top edge 119, 219 and inner peripheral edge 132, 232

Gutter inserts 100, 200 contact the corner sections of the eaves trough 102, 202 at the following contact areas. The horizontal bottom wall 104, 204 of gutter insert 100, 200 is configured to lay adjacent and contact base 112, 212 of the corner sections of the eaves trough 102, 202 respectively. The back wall 122, 222 of gutter insert 100, 200 lays adjacent and contacts the outer side wall 120, 220 of the corner section of an eaves trough 102, 202 proximate first upstanding edge 114, 214 and second upstanding edge 116, 216. Back wall 122, 222 of gutter insert 100, 200 forms a gap 180, 280 between back wall 122, 222 and outer side wall 120, 220 proximate outer apex 138, 238 which located between first upstanding edge 114, 214 and second upstanding edge 116, 216. Gutter inserts 100, 200 are glued or caulked to base 112, 212 and outer side walls 120, 220 at the contact areas described above thereby preventing water from entering the gap 180, 280.

The horizontal bottom wall 104, 204 together with the upstanding back wall 122, 222 of the gutter insert 100, 200 together with an inner side wall 118, 218 of the corner section of the eavestrough 102, 202 form a channel 124, 224 directing the flow of water smoothly around the corner of a corner section of an eaves trough 102, 202.

Gutter insert 100 and gutter insert 200 are designed to fit into corner sections of an existing eaves trough. They are placed into the corner sections of an existing eaves trough and sealed with suitable caulking along the bottom wall 104, 204, first and second transverse edges 108, 110, 208, 210 and first and second upstanding edges 114, and 116. This forms a new channel for the 124, 224 for the water to flow around the corner sections of an existing eaves trough 102, 202.

I claim:

1. A gutter insert designed to fit within a corner section of an eaves trough, the gutter insert comprising;

a) a substantially horizontal bottom wall which includes an arcuate back periphery, and an inner peripheral edge;

b) an upstanding back wall rigidly connected to the horizontal bottom wall surface at the arcuate back periphery of the horizontal bottom wall, wherein the upstanding back wall together with the horizontal bottom wall includes a first and a second transverse edge, which includes a first and second upstanding edge respectively;

c) the horizontal bottom wall is configured to lie adjacent to a base of the corner section of the eaves trough and extends between the an inner sidewall and an outer sidewall of the corner section of the eaves trough at the first and second transverse edges;

d) wherein the inner peripheral edge is configured to lie substantially adjacent the an inner sidewall of the corner section of the eaves trough;

e) such that the horizontal bottom wall, the upstanding back wall of the gutter insert, together with the an inner side wall of the corner section of the eaves trough form a channel directing the flow of water smoothly around the corner of the corner section of the eaves trough, trough: and f) wherein the upstanding back wall is substantially perpendicular to the horizontal bottom wall and contacts the outer side wall of the corner section of the eaves trough, at the first and second upstanding edge.

2. The gutter insert claimed in claim 1 wherein the inner peripheral edge is a V shape to follow the contour of the inner corner portion of the corner section of the eaves trough, wherein the inner apex of the corner section of the eaves trough is adjacent to an apex of the V shaped peripheral edge thereby preventing longitudinal movement of the gutter insert in an installed position within the corner section of the eaves trough.

3. The gutter insert claimed in claim 2 wherein a first arm and a second arm of the V shaped peripheral edge extend substantially perpendicular to each other.

4. A gutter insert designed to fit within a corner section of an eaves trough, the gutter insert comprising:

a) a substantially horizontal bottom wall which includes an arcuate back periphery, and an inner peripheral edge:

b) an upstanding back wall rigidly connected to the horizontal bottom wall at the arcuate back periphery of the horizontal bottom wall, wherein the upstanding back wall together with the horizontal bottom wall includes a first and a second transverse edge, which includes a first and second upstanding edge respectively:

c) the horizontal bottom wall is configured to lie adjacent to a base of the corner section of an eaves trough and extends between an inner sidewall and an outer sidewall of the corner section of the eaves trough at the first and second transverse edges:

d) wherein the inner peripheral edge is configured to lie substantially adjacent the inner sidewall of the corner section of the eaves trough:

e) such that the horizontal bottom wall, the upstanding back wall of the gutter insert, together with the inner side wall of the corner section of the eaves trough form a channel directing the flow of water smoothly around the corner of the corner section of the eaves trough:

f) wherein the upstanding back wall substantially follows the cross sectional contour of and lies adjacent to the outer side wall at the first and second upstanding edge.

5. The gutter insert claimed in claim 1, wherein the corner section of the eaves trough is an inside corner and the upstanding back wall deflects water around a corner in a smooth arcuate path.

6. The gutter insert claimed in claim 4, wherein the corner section of the eaves trough is an outside corner and the upstanding back wall deflects water around a corner in a smooth arcuate path.

7. The gutter insert claimed in claim 5, wherein a vertical height of the upstanding back wall is lower than a vertical height of the outer side wall of the corner section of the eaves trough.

8. The gutter insert claimed in claim 6, wherein a vertical height of the upstanding back wall is lower than a vertical height of the outer side wall top lip of the corner section of the eaves trough such that the back wall is wedged between the base and top lip of the corner section of the eaves trough.

* * * * *